United States Patent [19]

Kussel et al.

[11] Patent Number: 4,906,143

[45] Date of Patent: Mar. 6, 1990

[54] ELECTRO-HYDRAULIC CONTROL SYSTEMS

[75] Inventors: Willy Kussel, Werne; Johannes König; Martin Reuter, both of Munich, all of Fed. Rep. of Germany

[73] Assignee: Gewerkschaft Eisenhutte Westfalia GmbH, Fed. Rep. of Germany

[21] Appl. No.: 191,586

[22] Filed: May 9, 1988

[30] Foreign Application Priority Data

May 9, 1987 [DE] Fed. Rep. of Germany ..... 3715593

[51] Int. Cl.[4] ..... E21D 23/18

[52] U.S. Cl. ..... 405/302; 91/170 MP; 405/299

[58] Field of Search ..... 405/291, 299, 302; 91/170 MP; 299/33

[56] References Cited

U.S. PATENT DOCUMENTS

| | | | |
|---|---|---|---|
| 4,050,256 | 9/1977 | Phillips et al. | 405/299 |
| 4,089,182 | 5/1978 | Takahashi et al. | 405/302 |
| 4,451,181 | 5/1984 | Trumper et al. | 405/302 |
| 4,518,285 | 5/1985 | Weber et al. | 405/302 |
| 4,692,067 | 9/1987 | Ward et al. | 405/302 |

*Primary Examiner*—David H. Corbin

*Attorney, Agent, or Firm*—Samuels, Gauthier, Stevens & Kehoe

[57] ABSTRACT

An electro-hydraulic control system has a valve unit allocated to a roof support (support shield, support trestle or the like) and equipped with electromagnetic valves. The unit is controlled by a control unit via a cable which includes two current supply leads serving as a common current supply for all the electromagnetic valves and at least one data bus through which an actuator connected with the valve unit is actuated from a microprocessor of the control unit. The actuator itself consists preferably of a shift register through which all the electromagnetic valves can be actuated.

3 Claims, 2 Drawing Sheets

ELECTRO-HYDRAULIC CONTROL SYSTEMS

FIELD OF THE INVENTION

The present invention relates in general to electro-hydraulic control systems for mineral, e.g. coal, mining installations.

BACKGROUND TO THE INVENTION

In known electro-hydraulic control systems, a series of roof supports together with their associated hydraulically operated devices are disposed alongside a mineral face and each support has a control unit with a programmable electronic device, such as a microprocessor, used to actuate electromagnetic valves to operate the devices in some desired sequence.

Electro-hydraulic control systems are known in various versions (see "Glückauf", 1981, pp. 1155–1162; "Glückauf", 1984, pp. 135–140; "Glückauf", 1986, pp. 543–552 and "Glückauf", 1986, pp. 1183–1187). The systems in which an individual electronic control unit with its microprocessor is allocated to each support of the longwall working with all the individual control units being coupled with one another and possibly with a central control appliance through a data transmission link, the so-called "system bus", have proved their value in practice. The individual control units are usually provided with an operating keyboard, with the aid of which the various control operations (individual control actions, automatic flow control actions, sequence control actions) can all be initiated. The control system is also expediently supplied on a de-centralized basis with power at an intrinsically safe level. Also in the known electro-hydraulic control systems the electromagnetic valves are assembled as blocks or valve units associated with the individual supports. Each block may comprise a relatively large number of electromagnetic valves, not infrequently twenty or more, which must be electrically actuated individually or in groups by the associated control unit for the execution of the various control operations. This requires a very large number of electrical connections between the control unit and the valve unit. If the heavy valve unit is arranged spatially separately from the associated control unit, then for the production of the electrical connections it is necessary to provide a very large number of electrical conductors or a cable with a large number of electric cores.

It is a general object of the invention to reduce the number of the electrical connections to be produced between each control unit and its associated valve unit, preferably in such a way that in the case of spatial separation of the valve unit from the associated electronic control unit the electrical connection can be brought about with the aid of a cable having a maximum of four conductor cores.

SUMMARY OF THE INVENTION

In accordance with the invention, a valve unit with electromagnetic valves is connected to a current supply common to all the electromagnetic valves and is provided with an electronic actuator actuatable by the associated control unit through a data bus to switch the electromagnetic valves electrically individually or by groups. The valve unit is preferably connected through a multi-core cable with the remotely arranged control unit and the cable comprises two current supply conductors connected with an intrinsically safe power source and common to the electromagnetic valves and at least one, preferably two data conductors serving for data transmission.

The actuator can be combined with the valve unit or the valve block to form a constructional assembly spatially separate from the associated control unit. The actuator can, for example, comprise a microprocessor actuated by another microprocessor or computer of the system control unit. The actuator microprocessor then switches the electromagnetic valves individually or by groups in dependence upon serial command signals transmitted by way of the data bus. In another form the actuator can be a shift register which is in serial communication through the data bus with the microprocessor of the control unit. The shift register makes it possible to control all the electromagnetic valves of the valve unit, individually or even in groups through the one or two conductors making up the data bus.

The shift register can be formed from two shift register circuits or devices connected by way of the data bus with the control unit. One circuit serves for the electric switching of the electromagnetic valves and the other circuit serves as a monitor for the interrogation of the switch state of the electromagnetic valves. The switch state interrogation data can be relayed back by way of the data bus or an additional data bus to the electronic control unit.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENTS

Figure 1:
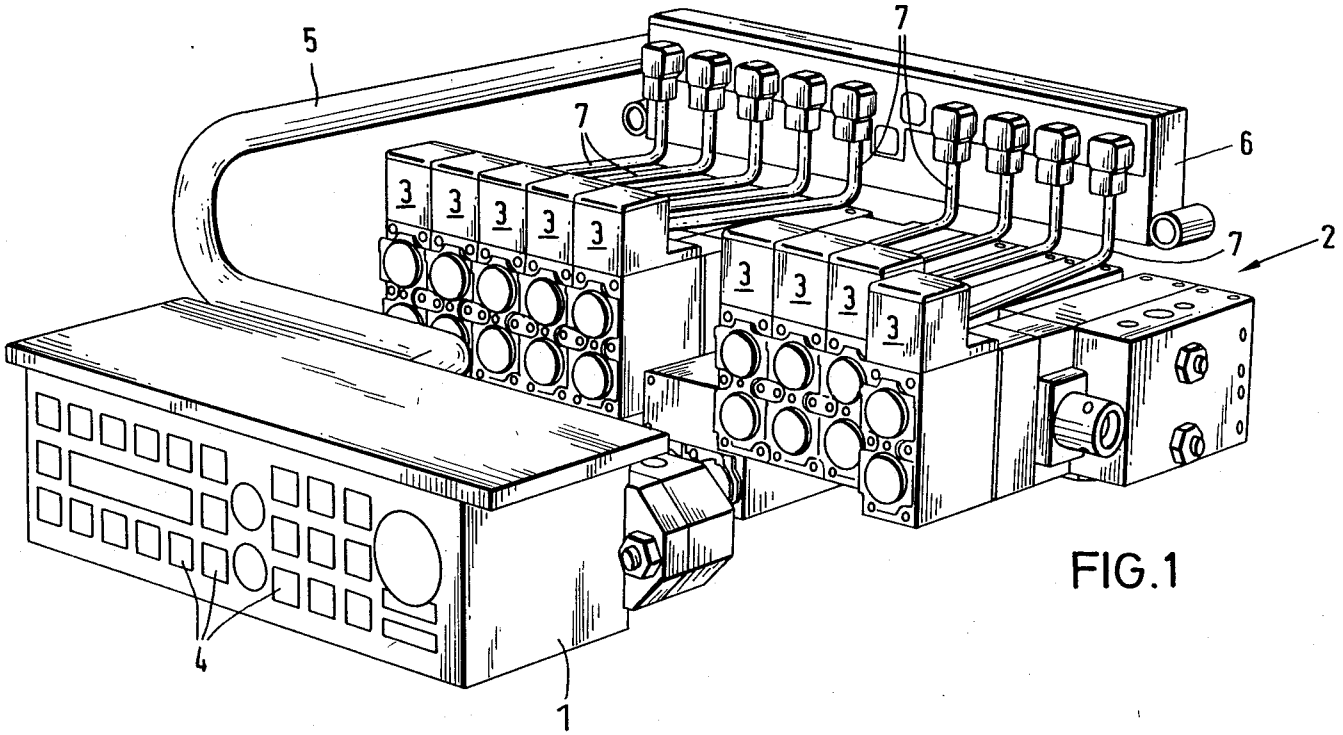
FIG. 1 is a perspective representation of an individual control unit with an associated valve unit and cable connection of an electro-hydraulic control system constructed in accordance with the invention.

In FIG. 1 an electronic control unit 1 normally arranged on a roof support, for example a support shield, a support trestle or the like is connected by a cable 5 to an associated valve unit 2 allocated to the same support structure. The valve unit 2 comprises a number of valves at least including electromagnetic valves 3 actuatable by the control unit 1 and combined in a valve block. In the simplified embodiment as shown only nine electromagnetic valves 3 are illustrated. The unit 1 is used to operate the valves selectively to control the flow of pressure fluid to hydraulic consumer devices.

As is known, the control unit 1 is part of the electro-hydraulic control system and comprises a microprocessor which can be programmed to electrically actuate the electromagnetic valves 3 of the associated valve unit 2 in some desired control sequence. The front of the control unit 1 is formed as an interface with a keyboard 4 for operation to initiate various control operations. The control unit 1 is connected to an intrinsically safe direct current source (not shown), preferably in a manner in which a group comprising for example eight to twelve individual control units 1 are fed together with the associated electrical consumers (e.g. the electromagnetic valves 3) by one common power source. The valve unit 2 and control unit 1 on each support of a mine working are spatially separate and interconnected by the cable 5 which is a multi-core cable. By way of example the control unit 1 can be situated at an easily accessible position on the underside of a roof girder, while the valve unit 2 can be arranged behind the unit 1 towards the goaf side and between the props of the same support. An actuator 6 shown in outline in FIG. 1, serves to interconnect the valves to the unit 1 via the cable 5 and is connected with the valve unit 2 to form one constructional assembly. The electromagnetic valves 3 are connected with the actuator 6 through conductive connections 7.

The cable 5 comprises at most four individual conductors or individual cores. Two of these individual conductors serve for a common current supply to all the electromagnetic valves 3 of the valve unit 2, while at least one and preferably two further conductors serve for inter active communication between the control unit 1 and the actuator 6. The additional conductor(s) accordingly form a data bus for the mutual data transmission between the unit 1 and the actuator 6.

All the electromagnetic valves 3 can be selectively actuated or electrically switched from the control unit 1 through an individual data bus or through only two data buses. The actuator 6 is accordingly constructed so that it receives electric command signals through the data bus and in turn switches the required electromagnetic valves in dependence upon these signals. For the actuator 6 it would be possible to use a microprocessor which is actuated by the processor or computer of the associated control unit 1 through the data bus. However the actuator 6 preferably consists of a shift register which is actuated from the microprocessor of the control unit 1 through the data bus as will now be explained.

Figure 2:
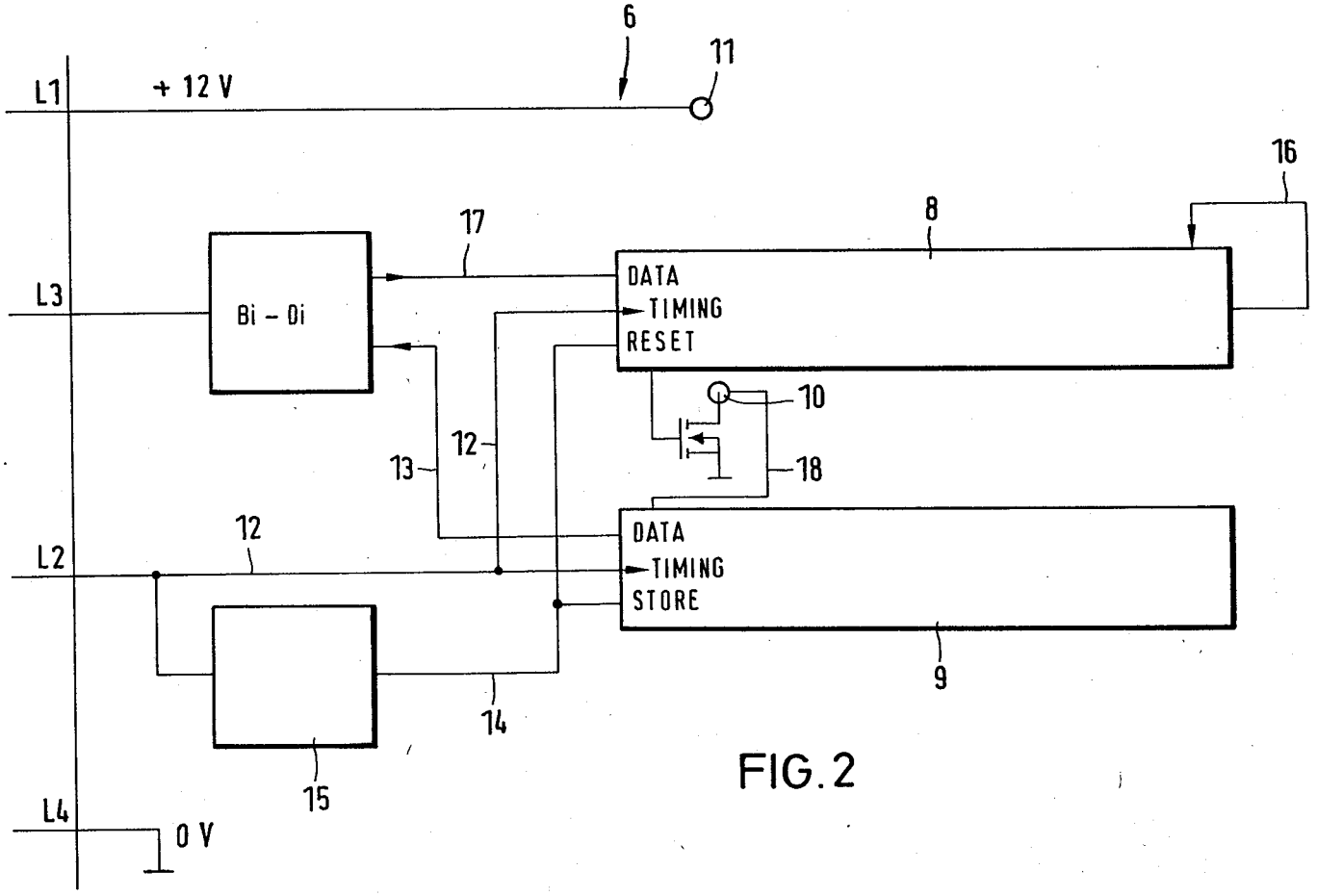
FIG. 2 shows in a schematic circuit diagram a preferred form of valve actuator in accordance with the invention.

FIG. 2 shows a preferred embodiment of such a shift register. As shown, the four conductors of the cable 5 are here designated by lines $L_1$ to $L_4$. The conductors or line $L_1$ and $L_4$ serve for the common current supply of the electromagnetic valves 3; accordingly they are connected through the associated control unit 1 with the intrinsically safe power source serving for the current supply. The other two conductors $L_2$ and $L_3$ each form a data bus and serve for data connection between the microprocessor of the control unit 1 and the shift register. The latter comprises two shift register circuits 8 and 9. The shift register circuit 8 is connected via connection 17 with the data bus $L_3$ and accordingly receives the data serially delivered by the microprocessor of the control unit 1, so that, as is known, for every data pulse the information in the shift register circuit 8 is shifted or incremented by one stage. Accordingly each electromagnetic valve 3 present, or even an individual group of these electromagnetic valves, is electrically actuatable by serial data transmission through the shift register circuit 8. The shift register circuit 8 has electric switches 10 corresponding to the number of the electromagnetic valves or the individual groups. In the case of selective actuation of the electromagentic valves 3 these are connected with a common terminal 11 connected with the current supply line $L_1$ lying at the higher potential, whereby the valve switching takes place. The manner of operation of the shift register circuit 8 with its transfer 16 is otherwise known and requires no further explanation.

The second shift register circuit 9 serves as a monitor for the interrogation and notification of the switch condition of the valves 3. It is coupled with the switches 10, which can be formed by transistors or the like, and in operation supplies a notification as to the state of these switches. The synchronous shift register circuit 9 could in certain cases also be omitted. On the input side of the shift register circuit 9 is connected through the line 12 to the data bus $L_2$ which is subjected to timing pulses. The other shift register circuit 8 is also coupled to the line 12 and likewise receives the timing pulses on the line $L_2$. The output of the shift register circuit 9 is connected via a connection 13 with the data bus $L_3$, with which the shift register circuit 8 is also coupled through the connection 17. The data bus $L_3$ accordingly serves for bidirectional data traffic between the control unit 1 and the shift register, that is both for transmission of the reception data through the connector 17 to the shift register circuit 8 and for the transmission of the monitoring data of the shift register circuit 9 through the connection 13. 14 designates a connection intended for the resetting of the shift register circuit 8 and for the charging of the shift register circuit 9. The connection 14 is provided by a device 15 which can recognize a prolonged synchronization timing pulse on the line $L_2$. The device 15 thus controls the reading-in of the reception data in the shift register circuit 8 and the simultaneous reading-out of the data in the shift register circuit 9.

In operation the first bit transmitted through the data bus $L_3$ and the connection 17 serves only for the transfer, 16. For reasons of simplification FIG. 2 shows only one single switch 10 for an electromagnetic valve 3. It is understood that for the selective and/or grouped actuation of the valves a correspondingly larger number of switches 10 are provided which are all switched through the shift register circuit 8.

The above-described valve actuator 6 is designed so that all electromagnetic valves 3 can be actuated in a directed manner through the four cores of the cable 5. The arrangement is preferably made such that a monitor logic ("watch-dog") automatically sets the electromagnetic valves 3 back into the switched-off position unless new data arrives from the microprocessor of the control unit 1 for example once every 0.5 seconds at the longest. The monitor logic thus prevents the execution of uncontrolled function inputs. The ideal condition of the valve outputs can then be read in afresh again from the microprocessor of the control unit 1. Light-emitting diodes on the valve actuator 6 can display the status of the connections to the control unit 1, for example green for the current supply, yellow for the data reception and red when the monitor logic has responded.

We claim:

1. An electro hydraulic control system for a mineral mining installation; said control system comprising a valve unit with a plurality of electro magnetic valves, a control unit remote from the valve unit for actuating the valves, an electronic actuator actuatable by the control unit through a data bus to switch the electro magnetic valves electrically, individually or in groups and a multi-core cable connecting the valve unit to the control unit, the cable having two current supply conductors for connection to an intrinsically safe power source providing a current supply common to the electro magnetic valves and at least one data conductor serving as the data bus for data transmission, wherein the actuator is a shift register with two shift register circuits connected through the data bus to the control unit, one of said shift register circuits serving for the electric switching of the electro magnetic valves and in response to serial data signals and the other of said shift register circuits serving for the interrogation of the switch conditions of the electro magnetic valves.

2. A control system according to claim 1, wherein the cable has two conductors serving as the data bus.

3. A control system according to claim 1, wherein the two shift register circuits are connected through a common connection to a common data bus for receiving timing pulses and to a second common data bus which serves for bi-directional data traffic.

* * * * *